US009484168B2

(12) United States Patent
Pessina et al.

(10) Patent No.: US 9,484,168 B2
(45) Date of Patent: Nov. 1, 2016

(54) DC CURRENT SWITCHING APPARATUS, ELECTRONIC DEVICE, AND METHOD FOR SWITCHING AN ASSOCIATED DC CIRCUIT

(71) Applicant: ABB S.p.A., Milan (IT)

(72) Inventors: Davide Pessina, Monza (IT); Romeo Bianchetti, Zurich (CH); Rudolf Gati, Niederrohrdorf (CH); Thorsten Strassel, Muelligen (CH)

(73) Assignee: ABB S.P.A., Milan (IT)

( * ) Notice: Subject to any disclaimer, the term of this patent is extended or adjusted under 35 U.S.C. 154(b) by 0 days.

(21) Appl. No.: 14/270,681

(22) Filed: May 6, 2014

(65) Prior Publication Data

US 2014/0332500 A1 Nov. 13, 2014

(30) Foreign Application Priority Data

May 7, 2013 (EP) ..... 13166880

(51) Int. Cl.
*H01H 33/04* (2006.01)
*H01H 9/54* (2006.01)

(52) U.S. Cl.
CPC ..... *H01H 33/04* (2013.01); *H01H 9/542* (2013.01); *H01H 2009/546* (2013.01)

(58) Field of Classification Search
CPC ..... H01H 9/30; H01H 9/465; H01H 9/50; H01H 9/54; H01H 9/541; H01H 9/542; H01H 9/547; H01H 2009/543; H01H 2009/544; H01H 2009/545; H01H 2009/546
USPC ..... 218/4; 361/2, 115
See application file for complete search history.

(56) References Cited

U.S. PATENT DOCUMENTS 3,436,597 A 4/1969 Hurtle
3,737,724 A 6/1973 Salge et al.
(Continued)

FOREIGN PATENT DOCUMENTS

CN 201 689 800 U 12/2010
DE 37 34 989 A1 4/1988
(Continued)

OTHER PUBLICATIONS

Search Report mailed on Oct. 24, 2013, by the European Patent Office for Application No. 13166880.8.

*Primary Examiner* — Renee Luebke
*Assistant Examiner* — William Bolton
(74) *Attorney, Agent, or Firm* — Taft Stettinius & Hollister LLP

(57) ABSTRACT

Exemplary embodiments are directed to a direct current switching apparatus including at least a first mechanical switching device which is suitable to be positioned along an operating path of an associated DC circuit and includes a fixed contact and a corresponding movable contact which can be actuated between a closed position and an open position along the operating path, wherein an electric arc can ignite between the contacts under separation. The switching apparatus includes an electronic circuit having a semiconductor device which is suitable to be positioned along a secondary path and connected in parallel with the first mechanical switching device. The electronic circuit can be configured to commute the flow of current from the operating path to the secondary path and extinguish an electric arc ignited when the movable contact separates from the fixed contact when the first mechanical switching device fails to extinguish the same.

16 Claims, 16 Drawing Sheets

(56) References Cited

U.S. PATENT DOCUMENTS

| | | | | |
|---|---|---|---|---|
| 4,251,845 | A * | 2/1981 | Hancock | 361/8 |
| 4,420,784 | A * | 12/1983 | Chen et al. | 361/7 |
| 4,658,320 | A * | 4/1987 | Hongel | 361/13 |
| 4,723,187 | A | 2/1988 | Howell | |
| 4,805,062 | A | 2/1989 | Shirouzu et al. | |
| 5,638,038 | A | 6/1997 | Suzuki et al. | |
| 5,703,743 | A | 12/1997 | Lee | |
| 5,793,586 | A * | 8/1998 | Rockot et al. | 361/8 |
| 6,956,725 | B2 * | 10/2005 | Boughton et al. | 361/7 |
| 2011/0222191 | A1 * | 9/2011 | Henke | 361/2 |

FOREIGN PATENT DOCUMENTS

| | | | |
|---|---|---|---|
| EP | 0 810 618 | A1 | 12/1997 |
| WO | WO 2005/099080 | A1 | 10/2005 |

* cited by examiner

DC CURRENT SWITCHING APPARATUS, ELECTRONIC DEVICE, AND METHOD FOR SWITCHING AN ASSOCIATED DC CIRCUIT

RELATED APPLICATION(S)

This application claims priority under 35 U.S.C. §119 to European Patent Application No. 13166880.8 filed in Europe on May 7, 2013, the content of which is hereby incorporated by reference in its entirety.

FIELD

The present disclosure relates to a direct current ("DC") switching apparatus, an electronic device, and a method for switching a DC current circulating along an associated DC circuit.

BACKGROUND INFORMATION

It is well known in the electrical field the use of protection devices, such as current switches, for example, circuit breakers or switch-disconnectors, which can be designed to switch an electrical system in which they can be installed for example, to protect the system from fault events, such as overloads and short circuits or for connecting and disconnecting a load.

Common electro-mechanical switching devices can include a couple of separable contacts to make, break and conduct current; in the breaking operation, a driving mechanism triggers the moving contacts to move from a first closed position in which they can be coupled to the corresponding fixed contacts, to a second open position in which they can be separated therefrom.

Usually, at the time the contacts start to physically separate from each other, the current continues to flow through the opened gap by heating up the insulating gas which surrounds the contacts themselves until the gas is ionized and becomes conductive, e.g., the so-called plasma state is reached; in this way, an electric arc is ignited between the contacts, which arc has to be extinguished as quickly as possible in order to definitely break the flow of current. For example, in direct current ("DC") applications, the interruption time can be quite high, and electric arcs can consequently last for a rather long time.

Such long arcing times can result in severe wear of the contacts, thus reducing significantly the electrical endurance, e.g., the number of switching operations that a mechanical current switch can perform.

For example, in order to quickly extinguish the arc and minimize such problems, the flowing current can be decreased and with it the heating power below a certain threshold where the heating is not sufficient to sustain the arc; the plasma cools down and loses its conductivity.

In a low voltage DC circuit, the current is reduced by building up a countering voltage exceeding the applied system voltage. The built-up voltage, exceeding the system voltage, should be maintained until the current is switched off; this voltage is usually produced by splitting up the arc in many short segments using a series of splitter plates.

To this end, for standard LV circuit breaker geometries, the arc has to be moved from the ignition area, where the contacts open, to the arc chamber where the splitting plates can be positioned; this can be done by exploiting a magnetic field generating a Lorentz force on the arc column.

This magnetic field can be generated by the same current flowing through the switching device. However, while having a capability to extinguish electric arcs with very high short circuit currents, known mechanical current switches can struggle to build up voltages above a certain value, for example, 600-1000V, and can have difficulty to extinguish electric arcs when switching operations can be carried out at low currents, for example, a few tens of Amperes.

In these cases it is therefore possible that at low currents an electric arc continues to burn on the contacts without being moved away from the contacts towards the arc splitting plates: as a consequence, the arc voltage built up is low and current is neither limited nor interrupted.

In some circuit breakers, an additional permanent magnet is usually provided for strengthening the magnetic field which acts on the arc column to move it towards the arc splitting plates. However, in this case, in addition to issues related to cost, position and space availability for this additional component, the circuit breaker is only able to interrupt currents with a given polarity defined by the placement of the permanent magnet. If the current flows in the opposite direction the arc is kept at the contacts which can be worn by the arc continuously burning on them.

It other known implementations hybrid current switching devices can be used in which a known or main mechanical circuit breaker is connected in parallel to a semiconductor-based current switching device.

These hybrid solutions can be aimed at having ideally arc-less switching operations or at least the extinguishing of electric arcs as fast as possible.

To this end, when the contacts of the mechanical breaker have to be opened, the flow of current is commuted towards the semiconductor device. In known implementations, the semiconductor can be driven into its conductive state even before the contacts of the mechanical breaker can be actuated; in other ones, the semiconductor is driven into its conductive state immediately after the contacts of the mechanical breaker can be actuated in order to remove the arc from the mechanical contacts as early as possible.

Although such hybrid solutions perform quite well, one of their shortcomings is that the semiconductor device, when driven in the conductive state, is always exposed to and has to face the flowing current which can reach very high levels. As a result, there is a high risk of possible damages and in any case, because in many operative conditions currents involved can be rather high, protections schemes and/or rather expensive components can be adopted or used.

SUMMARY

A direct current switching apparatus is disclosed comprising: at least a first mechanical switching device to be positioned along an operating path of an associated DC circuit, said mechanical switching device including a fixed contact and a corresponding movable contact, wherein an electric arc is ignited between said contacts when said movable contact starts separating from said fixed contact; and electronic means including at least one semiconductor device which is suitable to be positioned along a secondary path and connected in parallel with said first mechanical switching device, wherein said electronic means are configured to allow commuting the flow of current from said operating path to said secondary path and extinguishing the electric arc through said semiconductor device when said first mechanical switching device fails to extinguish the electric arc.

A method for switching a direct current circulating along an associated DC circuit is disclosed, the DC circuit including, along an operating path, at least a first mechanical switching device having a fixed contact and a corresponding movable contact, wherein an electric arc can ignite between said contacts when said movable contact starts separating from said fixed contact, and electronic means having at least one semiconductor device which is positioned along a secondary path of said DC circuit and connected in parallel with said first mechanical switching device, the method comprising: commuting the flow of current from said operating path to said secondary path; and extinguishing the electric arc, through said semiconductor device, when said first mechanical switching device fails to extinguish the electric arc.

An electronic device is disclosed, comprising: electronic means having at least one semiconductor device which is suitable to be positioned along a secondary path of an associated DC circuit and connected in parallel with a mechanical switching device which is suitable to be positioned along an operating path of said DC circuit, said mechanical switching device including a fixed contact and a corresponding movable contact which can be actuated between a closed position where said contacts are coupled to each other and current flows along said operating path, to an open position where said contacts are separated from each other to interrupt the flow of current along said operating path, said electronic means are configured to commute the flow of current from said operating path to said secondary path and extinguishing through said semiconductor device an electric arc ignited when said movable contact separates from said fixed contact when said first mechanical switching device fails to extinguish the electric arc.

BRIEF DESCRIPTION OF THE DRAWINGS

Further characteristics and advantages will become apparent from the description of preferred but not exclusive embodiments of a direct current ("DC") switching apparatus and related method for switching an associated DC current according to the disclosure, illustrated only by way of non-limitative examples in the accompanying drawings, wherein.

DETAILED DESCRIPTION

Figure 1:
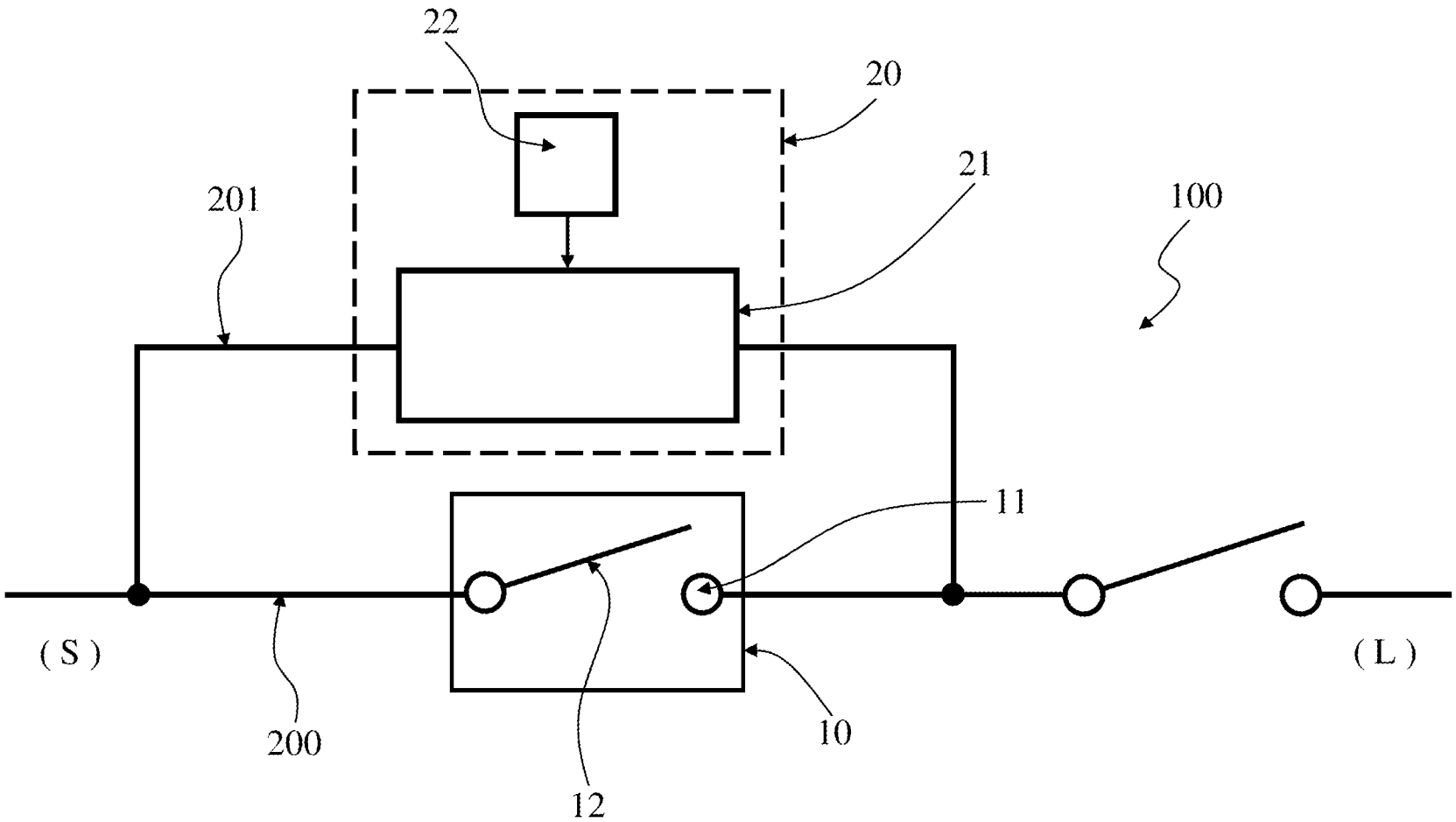
FIG. 1 is a block diagram schematically illustrating a first DC switching apparatus according to an exemplary embodiment of the present disclosure.

Exemplary embodiments of the present disclosure are directed to efficiently extinguishing electrical arcs especially at low currents, e.g., when the level of the flowing current is such that the arc does not move towards the splitting plates and the corresponding arc voltage is not enough for its self-extinguishment.

According to an exemplary embodiment of the present disclosure, a direct current ("DC") switching apparatus includes at least a first mechanical switching device which is suitable to be positioned along an operating path of an associated DC circuit. The mechanical switching device having a fixed contact and a corresponding movable contact which can be actuated between a closed position where the contacts can be coupled to each other and current flows along the operating path, to an open position where the contacts can be separated from each other to interrupt the flow of current along the operating path. An electric arc can ignite between the contacts when the movable contact starts separating from the fixed contact. The apparatus includes electronic means having at least one semiconductor device which is suitable to be positioned along a secondary path and connected in parallel with the first mechanical switching device. The electronic means can be configured to commute the flow of current from the operating path to the secondary path and extinguishing through the semiconductor device an electric arc ignited when the movable contact separates from the fixed contact when the first mechanical switching device fails to extinguish it.

Exemplary embodiments described herein also provide a method for switching a direct current ("DC") circulating along a DC circuit, including providing along an operating path of the DC circuit at least a first mechanical switching device having a fixed contact and a corresponding movable contact. An electric arc can ignite between the contacts when the movable contact starts separating from the fixed contact. Including the steps of providing electronic means including at least one semiconductor device which is positioned along a secondary path of the DC circuit and connected in parallel with the first mechanical switching device, commuting the flow of current from the operating path to the secondary path and extinguishing through the semiconductor device an electric arc ignited when the movable contact separates from the fixed contact when the first mechanical switching device fails to extinguish it.

According to exemplary embodiments of the present disclosure, a semiconductor device can be exploited in a manner substantially different from that of known solutions, such that the full flow of current is commuted from the nominal or operating path to the secondary path so that the semiconductor device can extinguish an electric arc ignited between the mechanical contacts only if the mechanical switching device is not able to extinguish the electric arc by itself.

When the contacts of the mechanical switching device separate from each other and an electric arc ignites between them, while in known solutions the semiconductor-based device is always activated in order to remove the arc quickly, according to exemplary embodiments described herein the semiconductor-based device is actively used to extinguish the arc only if the actual operative conditions can be such that the mechanical breaker is not able to do so, namely with switching operations at low currents, for example, on the order of some tens of Amperes.

In known circuits the aim of using semiconductor-based switching devices is to remove the arc immediately from the mechanical contacts independently from the level of current and even mainly to prevent that arcs burn at the contacts while the flowing current could reach high levels, in the present solution the semiconductor device is substantially prevented to operate when the current at the mechanical contacts is high, and its actual intervention to definitely extinguish the arc is exploited only when the level of flowing current is low.

In the detailed description that follows, identical or similar components, either from a structural and/or functional point of view, have the same reference numerals, regardless of whether they can be shown in different embodiments of the present disclosure; it should also be noted that in order to clearly and concisely describe the present disclosure, the drawings may not be to scale and certain features of the disclosure can be shown in somewhat schematic form.

When the term "adapted" or "arranged" or "configured" or "shaped", is used herein while referring to any component as a whole, or to any part of a component, or to a whole combinations of components, or even to any part of a combination of components, it has to be understood that it means and encompasses correspondingly either the structure, and/or configuration and/or form and/or positioning of the related component or part thereof, or combinations of components or part thereof, such term refers to.

Further, the term apparatus has to be understood herein as relating to a single component or to two or more separate components operatively associated to each other, even only at the installation site.

A DC switching apparatus according to the present disclosure will be described by making reference to its constructive embodiment as an exemplary multi-pole molded case circuit breaker, without intending in any way to limit its possible applications to different types of switching devices and with any suitable number of phases or poles, such as a modular circuit breaker, for example, bipolar, or any other circuit breaker as desired.

FIG. 1 is a block diagram schematically illustrating a first DC switching apparatus according to an exemplary embodiment of the present disclosure. In FIG. 1 there is represented schematically a direct current ("DC") switching apparatus (hereinafter the "apparatus"), globally indicated by the reference number 100.

The apparatus 100 includes at least a first mechanical switching device 10 which is suitable to be positioned along a nominal or operating path 200 of a DC circuit; the nominal or operating path is the usual path followed by the current in normal operating conditions from a source (S) towards a load to be powered (L).

The mechanical switching device 10 includes a fixed contact 11 and a corresponding movable contact 12 which can be actuated between a closed position where the contacts 11, 12 can be coupled to each other and current flows along the operating path 200, to an open position where the contacts 11, 12 can be separated from each other to interrupt the flow of current along the operating path 200; as known, an electric arc can ignite between the contacts 11, 12 when the movable contact 12 starts to physically separate from the fixed contact 11.

Figure 9:
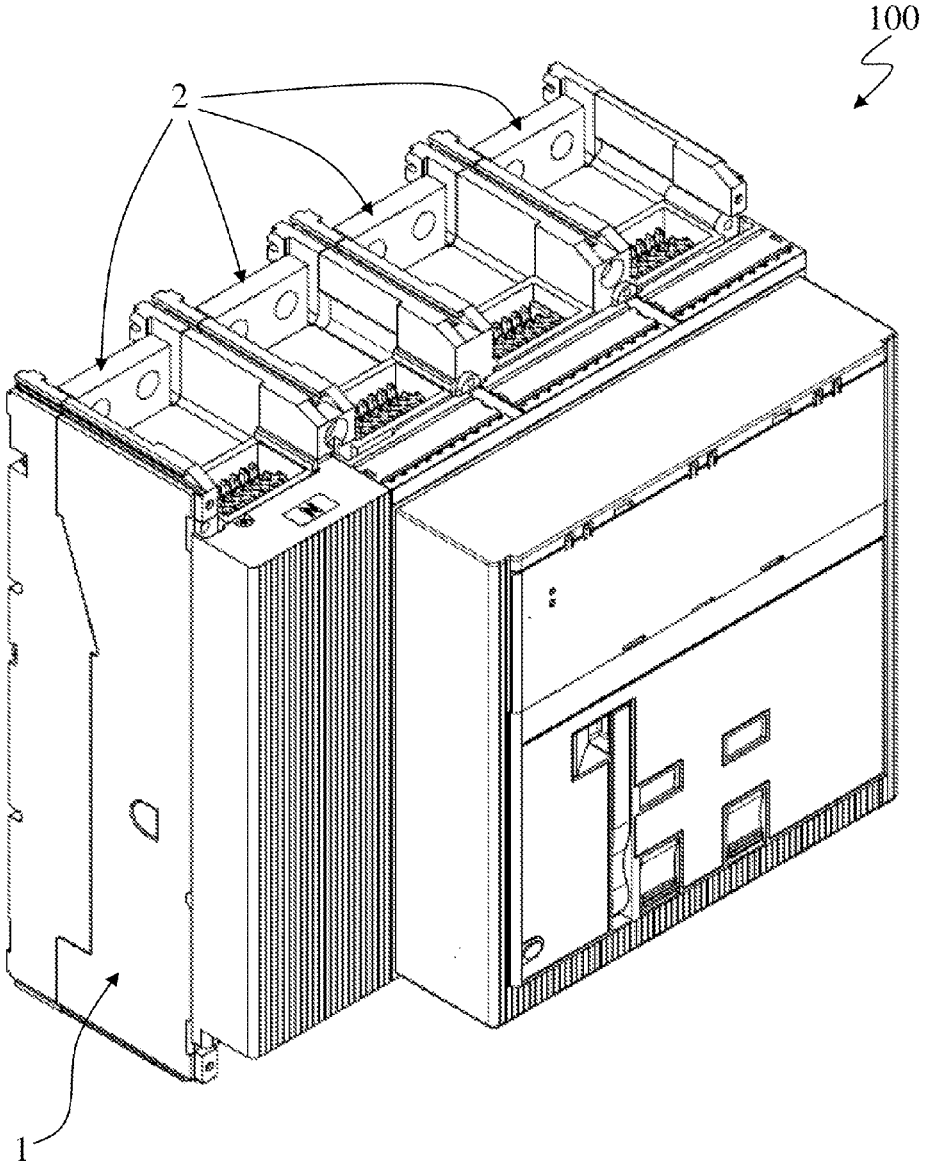
FIG. 9 is a perspective view showing a DC switching apparatus of a multi-pole molded case circuit breaker according to an exemplary embodiment of the present disclosure.

The mechanical switching device 10 can be any traditional mechanical current interrupter or part thereof, for example, the mechanical interruptive part or pole of a modular or molded case circuit breaker, for example, the one illustrated in FIG. 9.

The apparatus 100 according to the present disclosure includes also electronic means, globally indicated by the reference number 20, which includes at least one semiconductor device 21 which is positioned along a secondary path 201 connected in parallel with the first mechanical switching device 10.

For example, the at least one semiconductor device 21 includes one or more IGBTs; for example, it is possible to use a single reverse blocking IGBT or two semiconductor devices having a given polarity.

The electronic means 20 can be configured to allow commuting the flow of current from the nominal path 200 to the secondary path 201 and to pass such current through the semiconductor device 21 as it causes the extinguishment of an electric arc ignited between the mechanical contacts 11, 12 only when the first mechanical switching device 10 fails to extinguish the arc by itself.

According to an exemplary embodiment, the electronic means 20 can be configured to allow commuting the flow of current from the operating path 200 to the secondary path 201 through the semiconductor device 21 to extinguish the electric arc by means of the semiconductor device 21 itself, only when and/or until the level of flowing current is below a predefined threshold ($I_{th}$).

Figure 2:
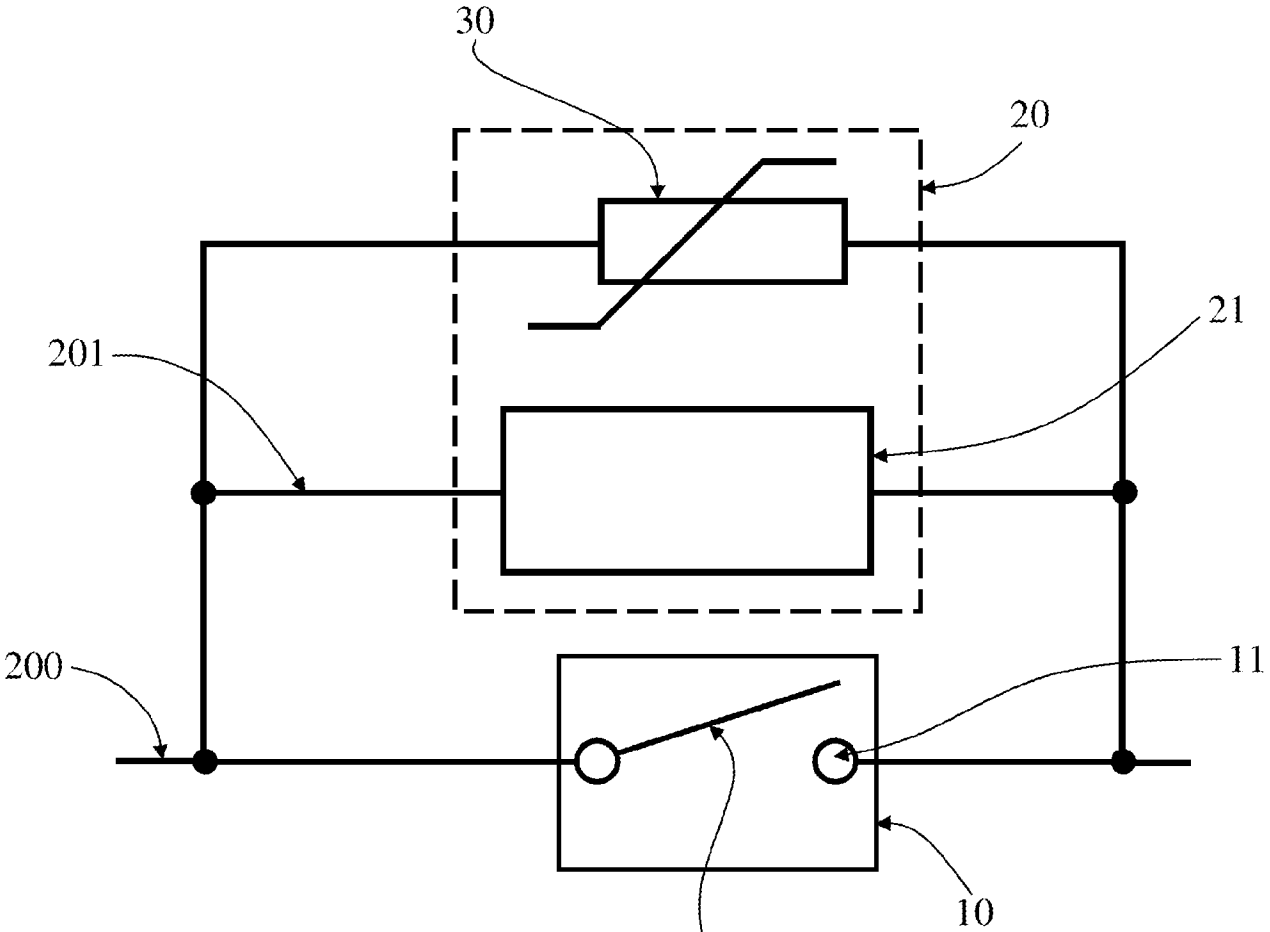
FIG. 2 is a block diagram schematically illustrating a second DC switching apparatus according to an exemplary embodiment of the present disclosure.

FIG. 2 is a block diagram schematically illustrating a second DC switching apparatus according to an exemplary embodiment of the present disclosure. As illustrated schematically in the embodiment of FIG. 2, the electronic means 20 includes a nonlinear resistor 30, such as a varistor, connected in parallel to the semiconductor device 21; such nonlinear resistor 30 is suitable to absorb and dissipate energy during current switching operations to allow the definitive interruption of current, as well as to protect the semiconductor device 21 from possible over-voltages, e.g., occurring when such semiconductor device 21 is turned off.

According to a possible embodiment, the electronic means 20 can be configured to be powered by the voltage generated by the electric arc ignited between the fixed and movable contacts 11, 12 when said movable contact 12 separates from said fixed contact 11; alternatively, the electronic means 20 can be powered by any other suitable source.

According to an exemplary embodiment, when the apparatus 100 is installed, the at least one semiconductor device 21 is in a non-conductive state when the fixed and movable contacts 11, 12 can be in closed position, e.g., in normal operating conditions, and the electronic means 20 can be configured to switch the semiconductor device 21 in its current conductive state after a first predetermined interval of time ($t_1$) has elapsed from the instant the movable contact 12 starts separating from the corresponding fixed contact 11.

In addition, the electronic means 20 can be also configured to subsequently switch the semiconductor device 21 from the conductive state to its non-conductive state either after a second predetermined interval of time ($t_2$) has elapsed with the semiconductor device 21 in its conductive state or, when the level of current flowing on the secondary path through the semiconductor device 21 exceeds the predetermined threshold ($I_{th}$) before the second predetermined interval of time ($t_2$) has elapsed.

The first predetermined interval of time ($t_1$) and the second predetermined interval of time ($t_2$) can be selected according to the applications; for example, ($t_1$) can be less than 500 ms, such as between 10 and 200 ms, for example, and ($t_2$) can be less than 10 ms, such as between 1 and 5 ms, for example.

For example, the time ($t_1$) can be selected so that, when the semiconductor device 21 is switched on, either the first mechanical switching device 10 has already extinguished the arc and therefore definitely interrupted the flow of current along the nominal path 200 (switch-on of the semiconductor device 21 is substantially void) or if current is still flowing, it means that the current is too low and the mechanical switching device is not able to extinguish the arc by itself. In turn, the time ($t_2$) can be selected so that it is sufficient for the current commutation and the recovery of dielectric properties of the air gap between the mechanical contacts 11, 12, in order to avoid an arc re-ignition in the mechanical switch 10 when the semiconductor device 21 is turned off.

As it can be appreciated by those skilled in the art, the electronic means 20 can be realized by any suitable combination of available electronic components, such as the ones illustrated in the various Figures, with a driver part 22 for switching on-off the semiconductor device 21 and, according to the embodiment just described, one or more timers.

Figure 3:
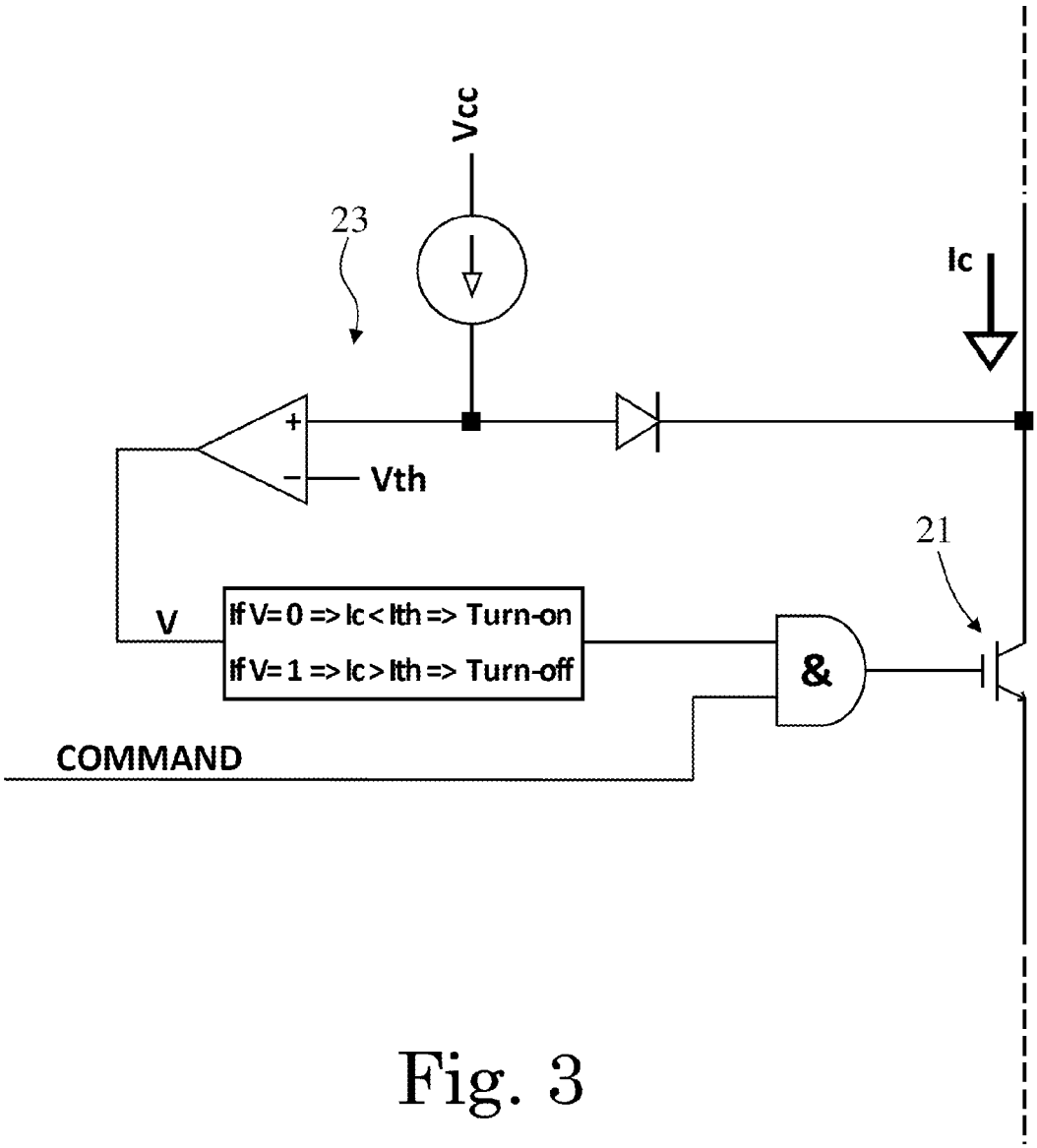
FIG. 3 is a block diagram schematically illustrating first electronic means used in a DC switching apparatus according to an exemplary embodiment of the present disclosure.

FIG. 3 is a block diagram schematically illustrating first electronic means used in a DC switching apparatus according to an exemplary embodiment of the present disclosure. As illustrated in FIG. 3, in order to protect the semiconductor device 21 from high level currents and if necessary to switch it off before the second predetermined interval of time ($t_2$) has elapsed, the electronic means 20 includes voltage monitoring means 23 for monitoring the voltage across the semiconductor device 21 and comparing the monitored voltage with a predetermined threshold ($V_{th}$). When the voltage detected exceeds the predefined threshold, which means that the current ($I_c$) circulating through the semiconductor device 21 is above the predefined threshold ($I_{th}$), the semiconductor device 21 is immediately switched off into its non-conductive state.

Figure 5:
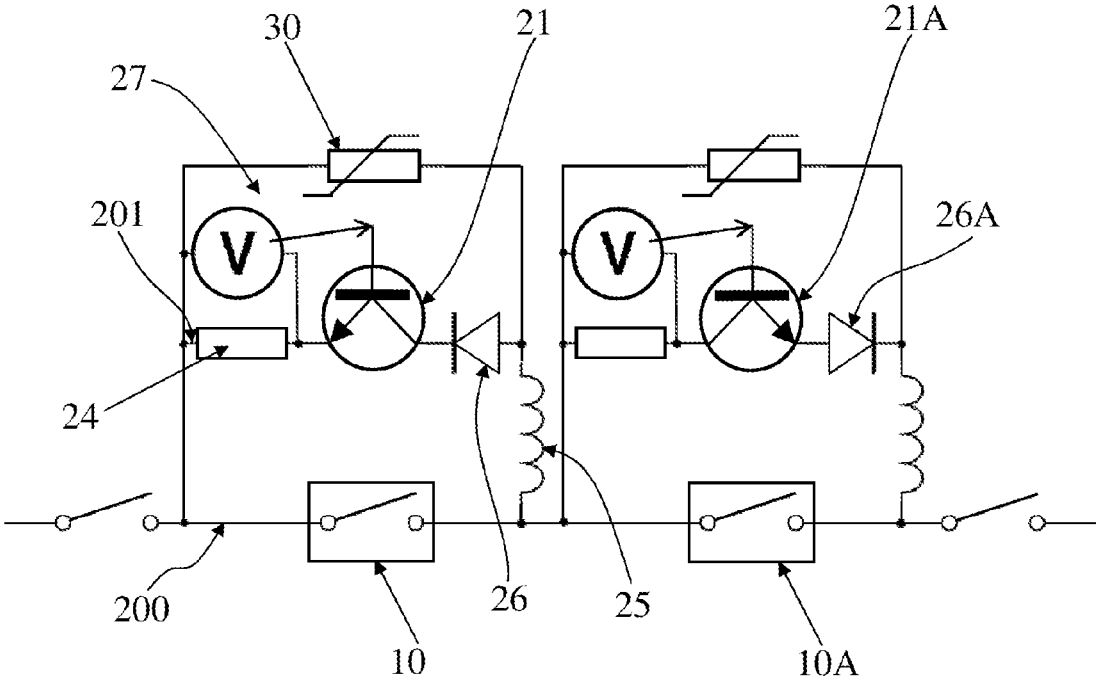
FIG. 5 is a block diagram schematically illustrating a third DC switching apparatus according to an exemplary embodiment of the present disclosure.

FIG. 5 is a block diagram schematically illustrating a third DC switching apparatus according to an exemplary embodiment of the present disclosure. As illustrated in FIG. 5, the electronic means 20 includes a resistor 24 connected in series with the semiconductor device 21 along the secondary path 201; in addition, as illustrated in FIG. 5, the electronic means 20 includes an inductor 25 connected in series with the semiconductor device 21 along the secondary path 201 to limit current-raise rates. A diode 26 which blocks a reverse current to a unidirectional operational switching semiconductor device 21 can be positioned between the semiconductor device 21 and the inductor 25.

The resistor 24 is configured, for example, dimensioned, to block commutation of current from the operating path 200 to the secondary path 201 through the semiconductor device 21 when the current circulating along the secondary path 201 exceeds the preselected threshold ($I_{th}$).

The arc voltage for a given current is determined by the design of the mechanical interruption part. The value of the resistor is chosen such that the arc voltage at low currents can commute the complete current, whereas in case of higher currents ($>I_{th}$) the voltage drop of the resistor due to the additional current cannot be overcome by the arc voltage.

In this way the semiconductor experiences a current which is still permissible for the device.

In practice the actual percentage of current commutation from the nominal path 200 to the secondary path 201 is driven by the voltage difference between the two paths, e.g., between the arc voltage and the voltage across the resistor 24.

According to an exemplary embodiment of the present disclosure, when the apparatus 100 is installed, the at least one semiconductor device 21 can be in a non-conductive state when the fixed and movable contacts 11, 12 can be in closed position, e.g., in normal operating conditions; the electronic means 20 can be configured to switch the semiconductor device 21 in its current conductive state after a first predetermined: interval of time ($t_1$) has elapsed from the instant the movable contact 12 starts separating from the corresponding fixed contact 11.

Like the previous embodiment, the electronic means 20 can be also configured to subsequently switch the semiconductor device 21 from the conductive state to its non-conductive state after a second predetermined interval of time ($t_2$) has elapsed with the second semiconductor device 21 in its conductive state.

If during commutation, the level of current commuted on the secondary path 201 exceeds the predetermined threshold ($I_{th}$), as above indicated, the resistor 24 prevents the commutation of a current above the semiconductor device's capabilities along the secondary path 201.

In this case, the electric arc is cleared by means of the mechanical switching device 10, and the semiconductor device 21 is switched off by the associated driver 22.

For example, according to this embodiment, and as a possible additional arrangement for the protection of the semiconductor device 21, the electronic means 20 includes voltage monitoring means 27, having for example, a voltage comparator, for monitoring the voltage over the resistor 24; if the voltage over the resistor 24 exceeds a set threshold, the semiconductor 21 is switched off and the current is then safely commuted back to the nominal path 200.

In this configuration the resistor 24 has therefore a double role, namely it is used to block over-currents in parallel to the arc and to sense the current flowing in the parallel secondary path 201.

The inductor 25 should be properly sized in order to ensure a slow current commutation, which can be specified for a reliable voltage measurement and to allow for delays introduced by the electronic control; the inductor 25 limits the current commutation rate to the parallel path, prevents a fast commutation of the current back to the arc in case of a semi-conductive switching operation, and enables a more reliable voltage measurement over the resistor 24.

It is also possible to monitor the level of circulating current directly or indirectly by monitoring the voltage build-up across the mechanical switching device 10.

Figure 6:
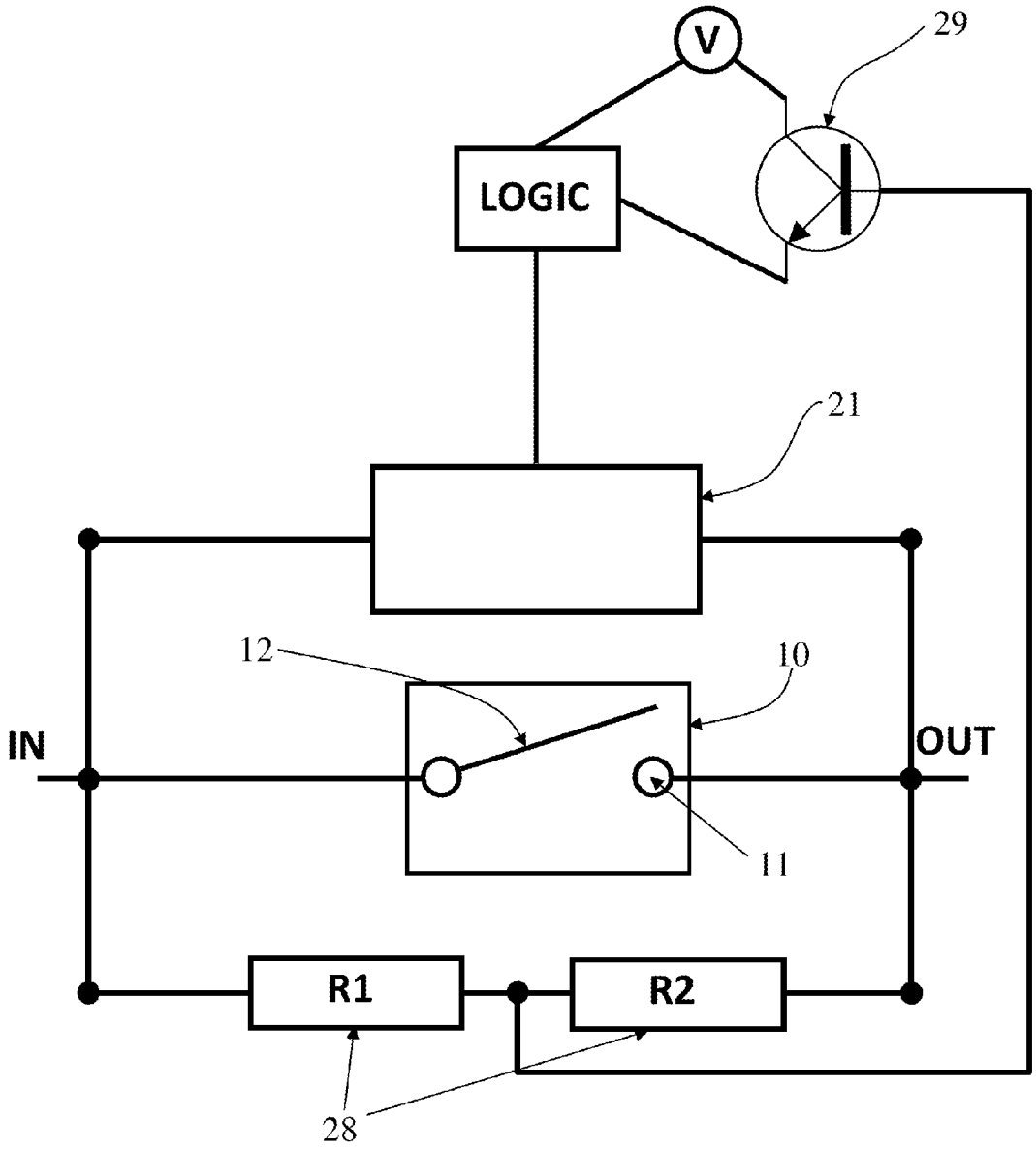
FIGS. 6-8 are block diagrams schematically illustrating third electronic means used in a DC switching apparatus according to an exemplary embodiment the present disclosure.
Figure 7:
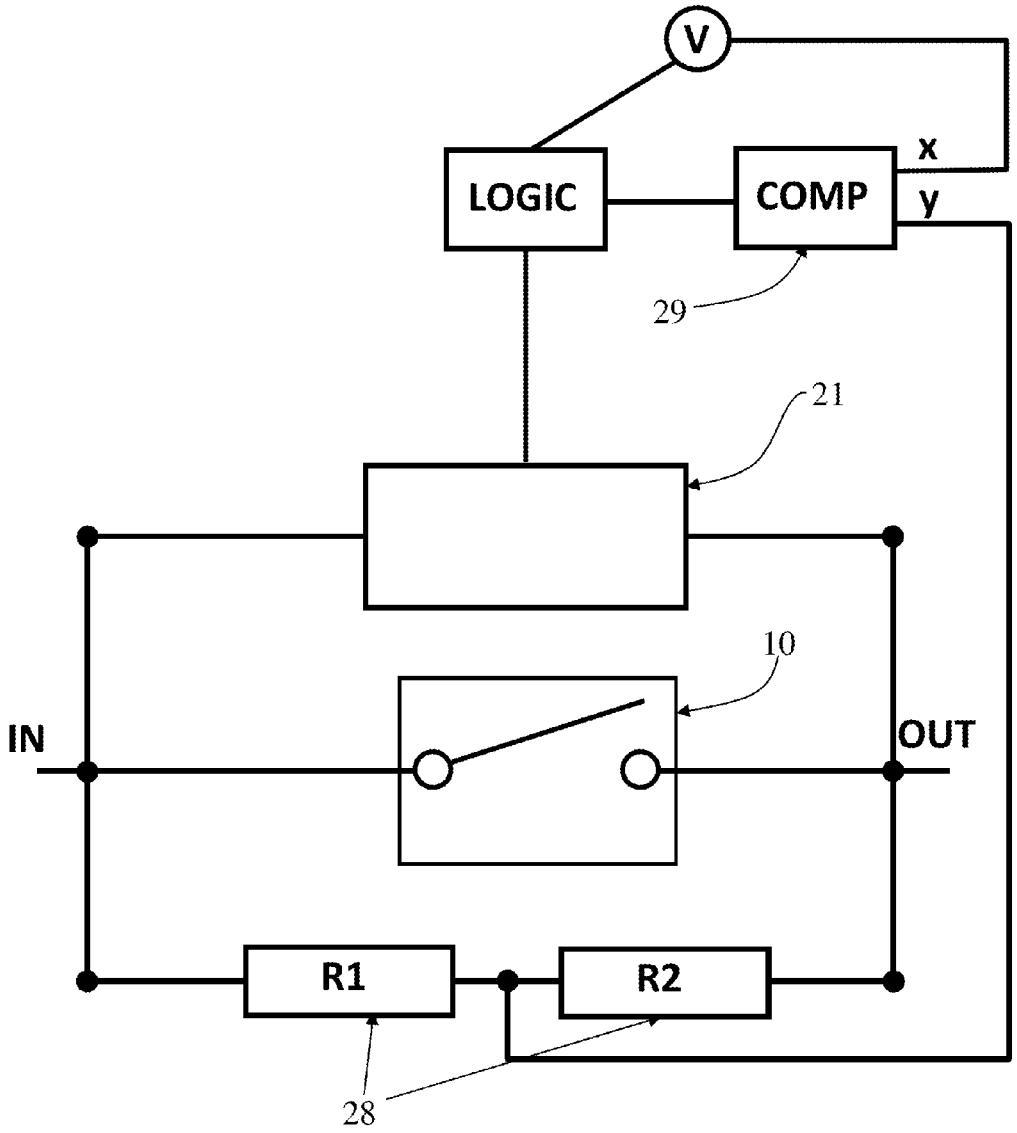
Figure 8:
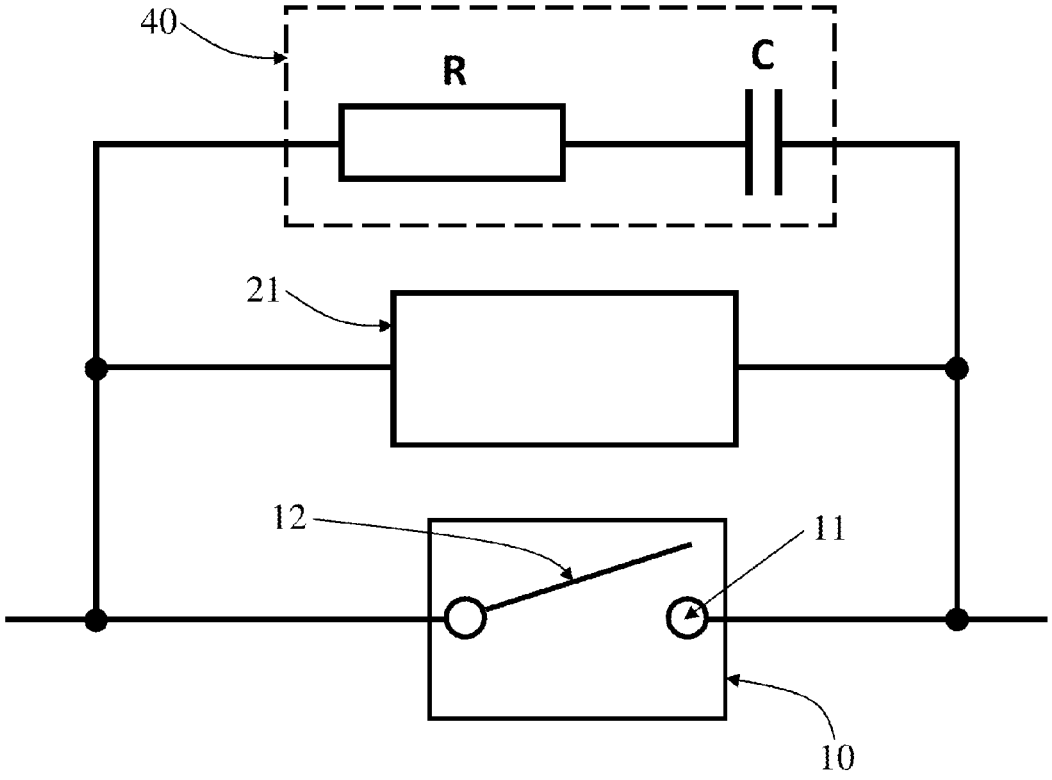

FIGS. 6-8 are block diagrams schematically illustrating third electronic means used in a DC switching apparatus according to an exemplary embodiment the present disclosure. As illustrated in FIG. 6, the electronic means 20 can include means for monitoring the level of the flowing current. For example, the current monitoring means can include a voltage divider, such as two resistors 28 and a transistor 29 in a voltage divider configuration. The divided arc voltage drives the transistor 29 which keeps the semiconductor device 1 in its conductive state when turned on or keeps the semiconductor device 21 in its non-conductive state when the level of current monitored exceeds the predetermined threshold.

A monitored voltage above a preselected threshold is a direct indication of the arc being in the arc chute and therefore the switching operation is happening at a high current. The mechanical breaker is able to operate in these conditions and the semiconductor device is kept in its nonconductive state.

Other alternative embodiments can be possible for such monitoring means, for example, illustrated in FIG. 7 where the transistor is replaced by a comparator 290.

In combination with any of the previously described embodiments, the electronic means 20 can include a further protective part, namely a snubber circuit, indicated in FIG. 8 by the reference number 40, which is connected in parallel with the semiconductor device 21, and has for example, a resistor and a capacitor. This snubber circuit 40 is suitable to avoid excessive voltage transients during semiconductor device 21 turn off.

Figure 10:
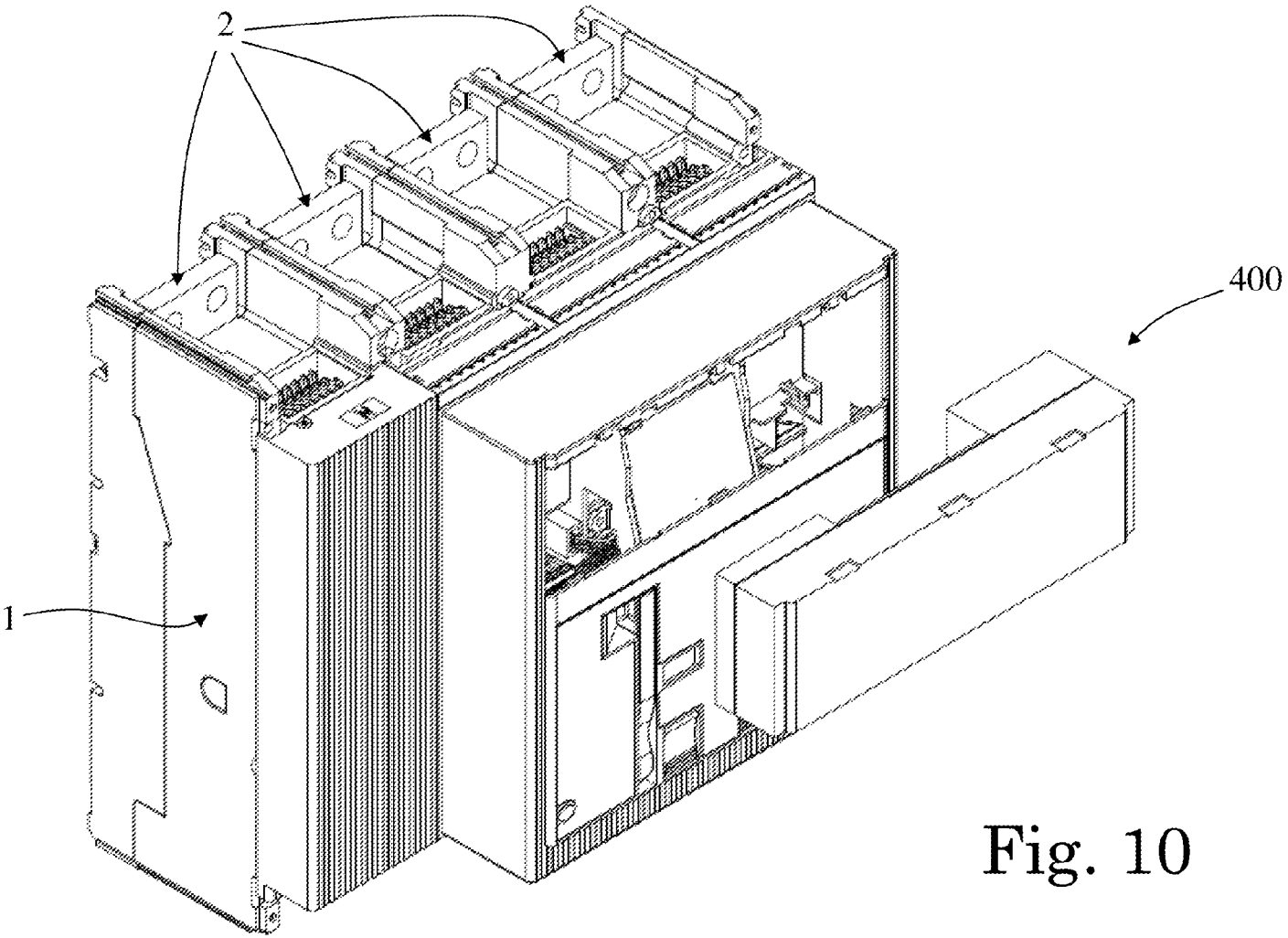
FIG. 10 is a perspective view showing the circuit breaker of FIG. 9 with electronic means assembled with the mechanical switching part of the circuit breaker according to and exemplary embodiment of the present disclosure.

FIG. 9 is a perspective view showing a DC switching apparatus of a multi-pole molded case circuit breaker according to an exemplary embodiment of the present disclosure. FIG. 10 is a perspective view showing the circuit breaker of FIG. 9 with electronic means assembled with the mechanical switching part of the circuit breaker according to and exemplary embodiment of the present disclosure. FIGS. 9 and 10 show exemplary embodiments where the switching apparatus 100 is a multi-polar molded case circuit breaker.

Figure 11A:
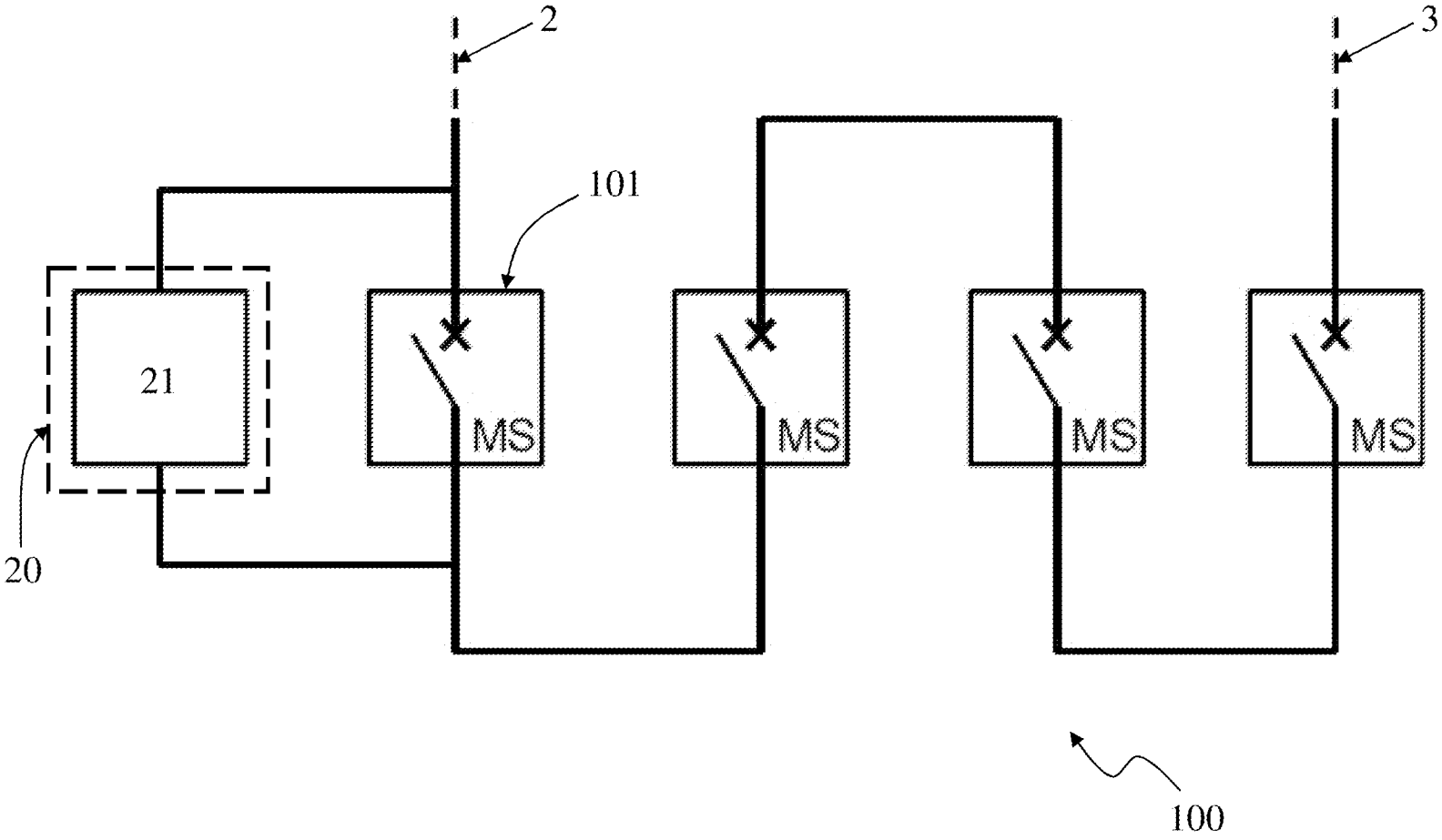
FIGS. 11*a*, 11*b*, 11*c* are block diagrams schematically illustrating connection options between the various mechanical switching devices and the electronic means of the circuit breaker of FIGS. 9 and 10 according to an exemplary embodiment of the present disclosure.
Figure 11B:
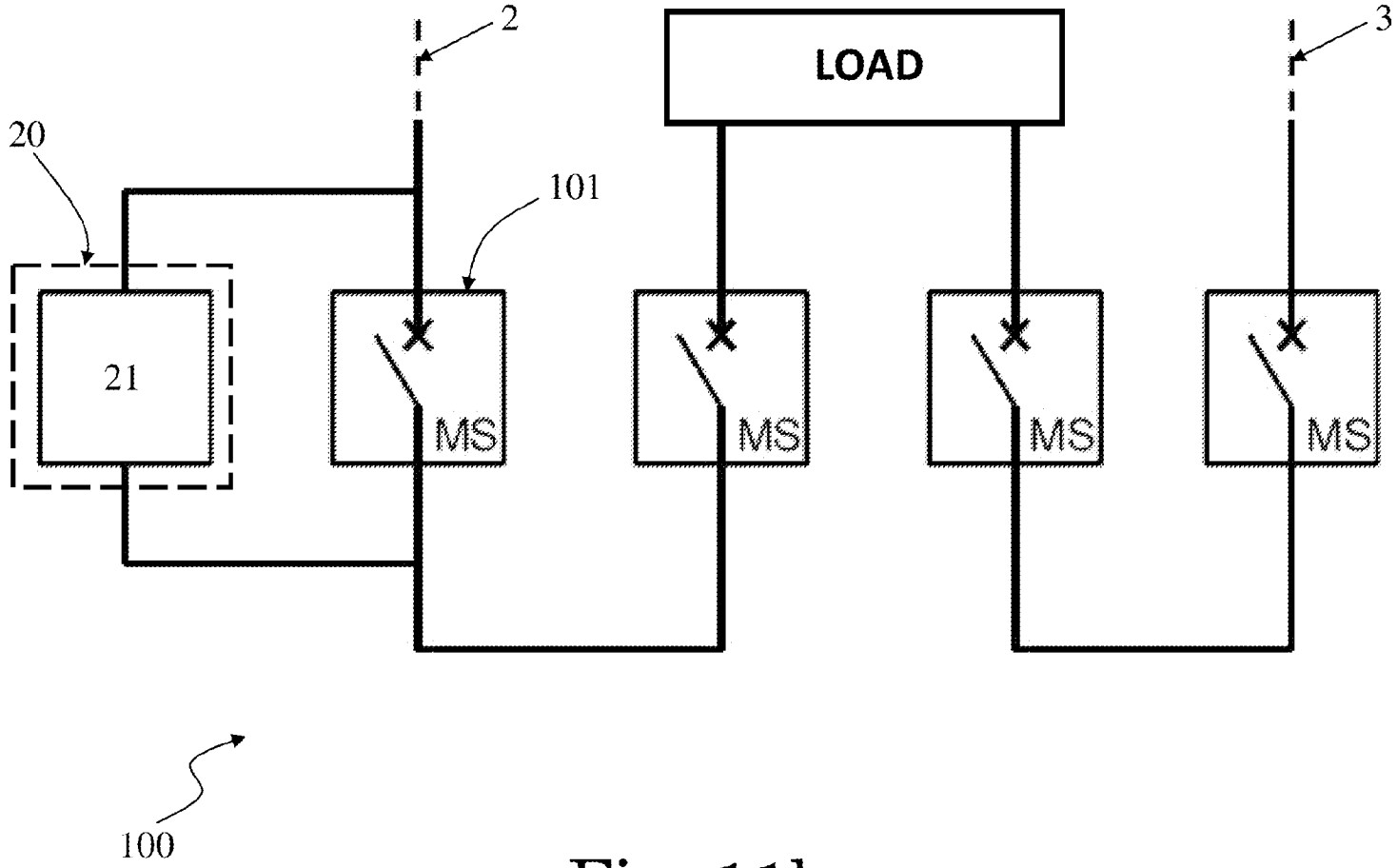
Figure 11C:
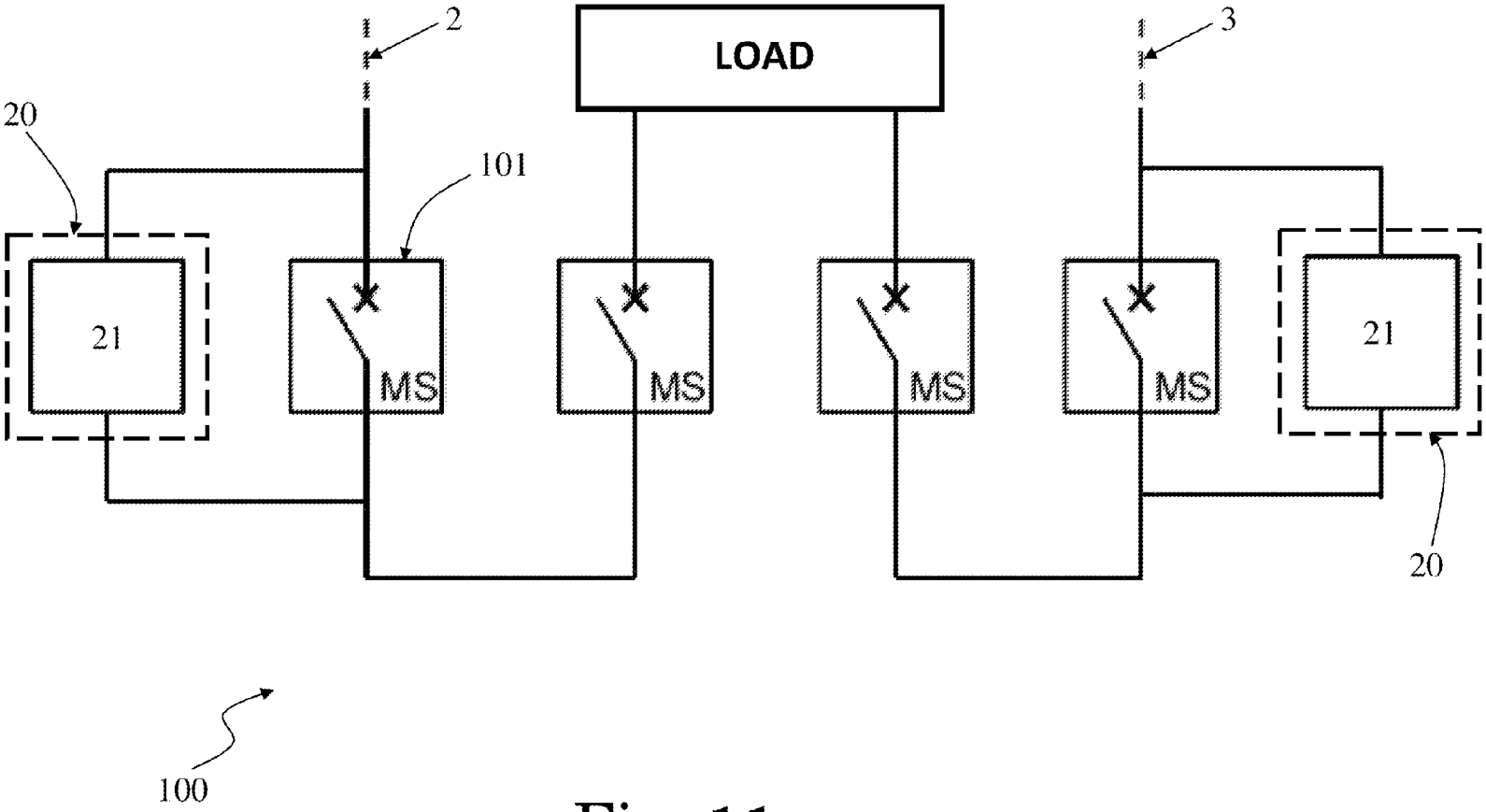

FIGS. 11*a*, 11*b*, 11*c* are block diagrams schematically illustrating connection options between the various mechanical switching devices and the electronic means of the circuit breaker of FIGS. 9 and 10 according to an exemplary embodiment of the present disclosure. FIG. 13 shows electronic means of FIG. 12 assembled with an associated mechanical switching device according to an exemplary embodiment of the present disclosure. As shown in FIG. 13, one of the poles of the circuit breaker of FIG. 10 which pole is indicated by the reference number 10 and is connected with the electronic means 20.

As illustrated, the circuit breaker 100 includes a casing 1 from which there protrude outside at least a first terminal and a second terminal suitable for input and output electrical connection with the associated DC circuit, respectively; in the version illustrated, there can be four upper terminals 2 and four corresponding lower terminals 3, only one output terminal 3 being visible in FIG. 13, that can be connected in a suitable way as in FIG. 11*a*.

It should be understood that FIG. 11*a* illustrates one of a plurality of connection options. In another exemplary connection as shown in FIG. 11*b*, a load is connected to the corresponding terminals of the two intermediary mechanical switching devices 10.

The exemplary connection option of FIG. 11*c*, can be suitable for applications having circuits with a double earth-fault, for example. In this case, the circuit includes second electronic means 20 and at least one other semiconductor device 21, substantially identical to what previously described, can be provided, and associated to another mechanical switching device, for example, the last one of the series.

According to an exemplary embodiment of the present disclosure, the first mechanical switching device 10 is positioned inside the casing 1 and is in practice constituted by one of the poles of the circuit breaker, for example, the pole 10 of FIG. 13. For example, in the exemplary embodiment illustrated in FIGS. 9-11 the circuit breaker 100 includes a plurality of first mechanical switching devices 10 housed inside the casing 1 and connected in series to each other, as represented schematically in FIG. 11. In practice, each current switching device 10 is constituted by a corresponding pole of the circuit breaker, like the illustrated pole 10, and includes at least a fixed contact 11 and a corresponding moving contact 12 which can be actuated to move from an initial closed position where it is coupled with its associated fixed contact 11 to an open position where the moving contact 12 separates from the associated fixed contact 11.

As represented in FIGS. 11*a*, 11 *b*, and 11*c*, the semiconductor device 21 is connected in parallel to at least one of the plurality of first mechanical switching devices 10.

According to an exemplary embodiment described herein, full galvanic isolation can be realized without specifying additional switches outside the casing 1.

The electronic means 20 including the semiconductor device 21 can be positioned inside or outside the casing 1.

Figure 12:
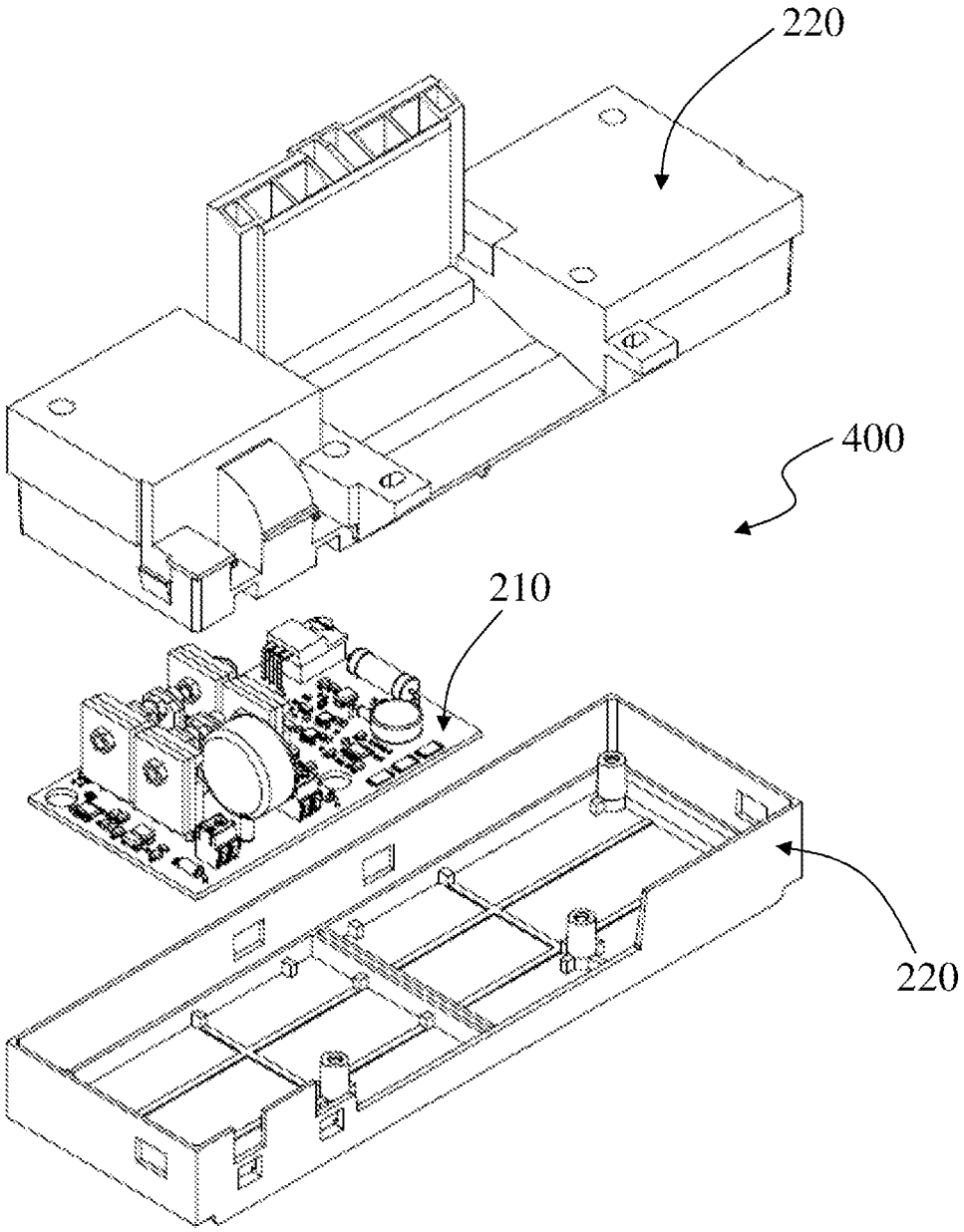
FIG. 12 illustrates fourth electronic means which can be used in a DC switching apparatus according to an exemplary embodiment of the present disclosure.
Figure 13:
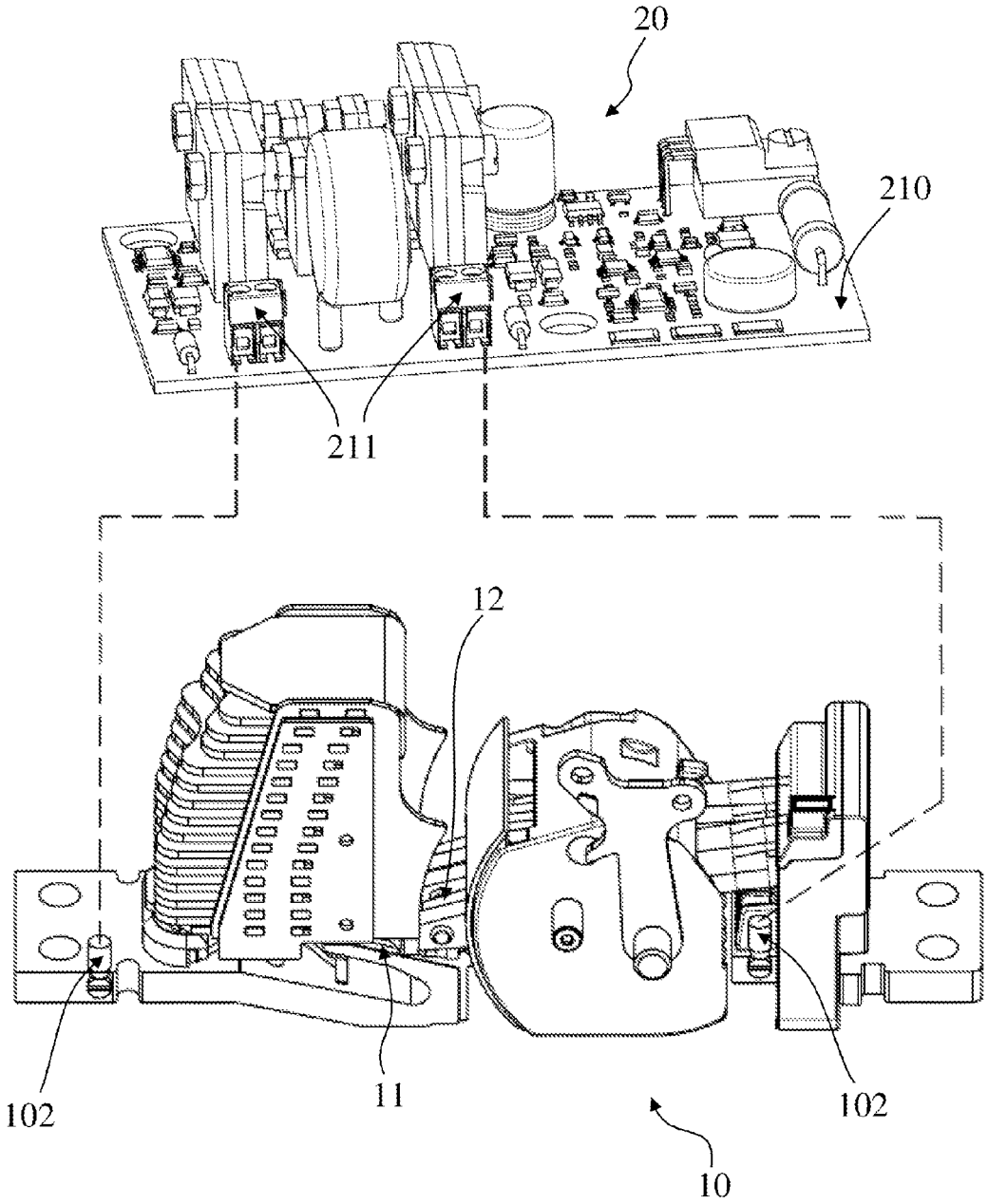
FIG. 13 shows electronic means of FIG. 12 assembled with an associated mechanical switching device according to an exemplary embodiment of the present disclosure.

FIG. 12 illustrates fourth electronic means which can be used in a DC switching apparatus according to an exemplary embodiment of the present disclosure. As shown in FIG. 12, the electronic means 20 with the at least one semiconductor device 21 can be positioned on a support board 210 and housed in a container 220, thus taking the form of a stand-alone component. Such component can be accommodated inside the casing 1, as shown in FIG. 10, for example with connecting pins 102 of the pole 101 engaging into corresponding input 211 provided on the support board 210, as illustrated in FIG. 13.

The electronic means 20 can be positioned at the installation site separately from the first mechanical switching device, for example, separately from the circuit breaker 100, and can be connected operatively therewith from outside the casing 1.

Figure 14:
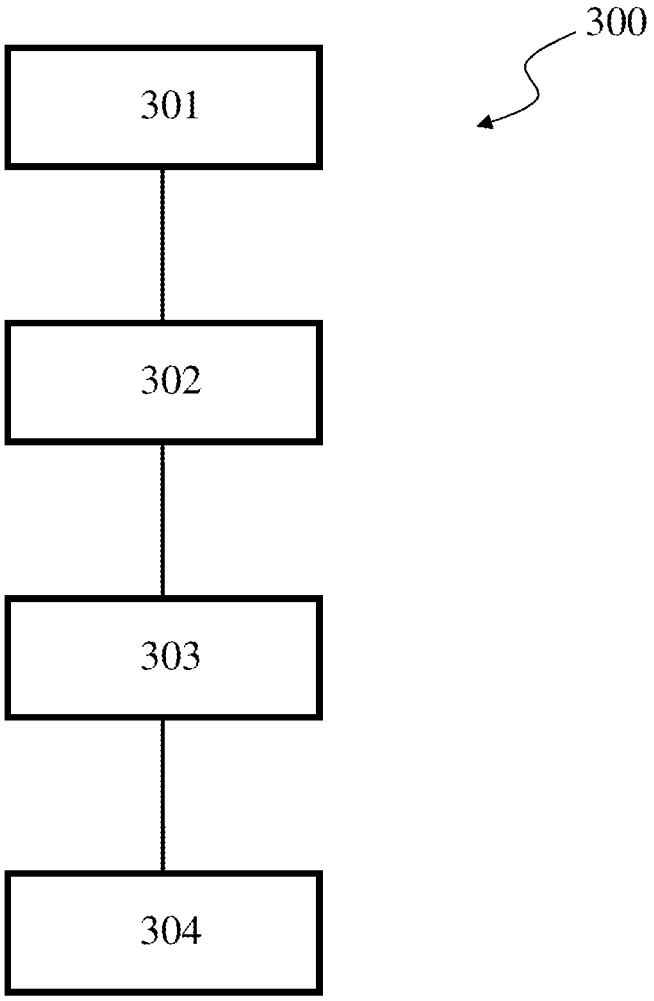
FIG. 14 is a flow diagram of a method for switching a direct current circulating along an associated DC circuit according to an exemplary embodiment of the present disclosure.

FIG. 14 is a flow diagram of a method for switching a direct current circulating along an associated DC circuit according to an exemplary embodiment of the present disclosure.

At a first step 301 of the method 300, there is provided, along a nominal or operating path 201 of the DC circuit at least a first mechanical switching device 10 having a fixed contact 11 and a corresponding movable contact 12, as described, an electric arc can ignite between the contacts 11-12 when the movable contact 12 starts separating from the fixed contact 11.

At step 301, there can be also provided electronic means 20 including at least one semiconductor device 21 which is positioned along a secondary path 201 of the DC circuit and connected in parallel with the first mechanical switching device 10.

As it will be appreciated by those skilled in the art, the first mechanical switching device 10, and the electronic means 20 can be provided at step 301 simultaneously or in whichever order.

In normal operating conditions, the fixed and movable contacts 11-12 can be coupled and the current flows through them along the nominal or operating path 200 of the DC circuit.

When the movable contact 12 starts to separate from the fixed contact 11 and an electric arc is ignited between them, the method 300 foresees at step 302 to commute the flow of current, and for example, up to the full flow of current, from the operating path 200 to the secondary path 201 and causes the electric arc ignited to be extinguished by means of the semiconductor device 21 when the first mechanical switching device 10 fails to extinguish it by itself.

For example, the step of commuting 302 includes commuting the flow of current from the operating path 200 to the secondary path 201 through the semiconductor device 21 up to when the full current is commuted, only if and until the level of flowing current is above zero and below a predefined threshold ($I_{th}$).

According to a first exemplary embodiment, the semiconductor device 21 is initially in a non-conductive state and the step of commuting 302 includes a step 303 of switching the semiconductor device 21 in its current conductive state after a first predetermined interval of time ($t_1$) has elapsed from the instant the movable contact 12 starts separating from the corresponding fixed contact 11.

The full flow of current can be commuted along the secondary path 201.

According to this exemplary embodiment, the method 300 further includes subsequently switching at step 304 the semiconductor device 21 in its non-conductive state either after a second predetermined interval of time ($t_2$) has elapsed or when the level of current flowing through the secondary path exceeds the predetermined threshold ($I_{th}$) before the second predetermined interval ($t_2$) of time has elapsed.

If separation of the mechanical contacts is occurring at a certain level of current, namely high current, for example, above 100 A, the first mechanical switching device 10 switches off completely the current and therefore the arc is cleared without specifying commuting the current along the secondary path 201. If instead separation of the mechanical contacts 11, 12 is occurring at low currents, for example, between 10 and 100 A, it is possible that the first mechanical switching device 10 is not capable of extinguishing the electric arc. Hence after the first fixed interval of time ($t_1$) the semiconductor device 21 is switched in its conductive state; the arc voltage commutes the current to the parallel secondary path 201 and the nominal path 200 is allowed to cool, recovering dielectrically. After a second predetermined interval of time ($t_2$), which is usually shorter than the first one ($t_1$), during which ideally the full flow of current is commuted along the secondary path 201, the semiconductor device 21 is switched off and the arc between the contacts 11 and 12 is extinguished.

The current is commuted to the varistor 30 and switched off.

According to another exemplary embodiment, for example by using the configuration apparatus of FIG. 5, the commutation of current along the secondary path 201 is blocked via the resistor 24 if the current exceeds a predetermined threshold. As already discussed, this is obtained thanks to the fact that the characteristics of the mechanical switching device 10 can be known and the resistor 24 is sized accordingly in order to allow passage of current through the semiconductor device 21 only until the circulating current does not exceed such threshold.

In this embodiment, the switching sequence works as follows.

In the nominal state or under normal operating conditions the semiconductor device 21 can be non-conducting and the mechanical contacts 11, 12 can be coupled. After a first predetermined interval of time has elapsed from the instant the contacts 11, 12 start to separate, the semiconductor device 21 can be switched to the conductive state and the commutation process starts in the presence of the arc between the contacts 11, 12. The voltage difference between the two paths, namely the arc voltage and the voltage over the resistor 24, drives the current commutation. The specified time is proportional to the inductance 25 and inversely proportional to the voltage difference. If the current commuted does not exceed the predefined threshold, for example, switching occurs at low currents, the arc voltage is higher than the voltage over the resistor 24 and the entire current is commuted to the parallel path 201 so that the arc is extinguished by means of the semiconductor device 21.

The semiconductor device 21 is switched off after remaining in the conductive state for a second predefined interval of time. During this second interval, the current is commuted to the parallel path and the arc channel is cooled. The nominal path 200 does not reignite and during the switching off of the semiconductor device the current is commuted to the parallel varistor 30 which clears the remaining current.

The current in the parallel secondary path 201 being high enough means that the arc voltage will be equal to or lower than the voltage over the resistor 24 (neglecting the small voltage drop over the semiconductor device 21). In this case, the commutation is stopped due to a lack of voltage difference driving further current commutation and the semiconductor device 21 can be switched off. In this condition the current is commuted back to the nominal path 201. The semiconductor is safely in its non-conductive state and the mechanical breaker is operating in a current regime, e.g., high currents, where it is able to clear the current by itself. The parallel path 201 is therefore protected from overcurrents by the resistor 24 and the known arc characteristic.

The exemplary apparatus 100 according to the present disclosure allows achieving some improvements over known solutions and for example, is able to solve the problem of switching operations and related extinguishment of arcs occurring at low currents where a traditional mechanical DC breaker can fail. Such conditions can be, for example, quite common in solar power plants where higher voltages can be specified and many switching operations occur at the nominal low current.

This result can be achieved by using a quite simple and cheap structure, for example, low power semiconductors can be used; further, it can be easily used with different types of mechanical switching devices, such as molded case circuit breakers (MCCB) or miniature circuit breakers (MCB) because the electronic means specifies a very small volume and can solve the issue of current polarity.

Figure 4:
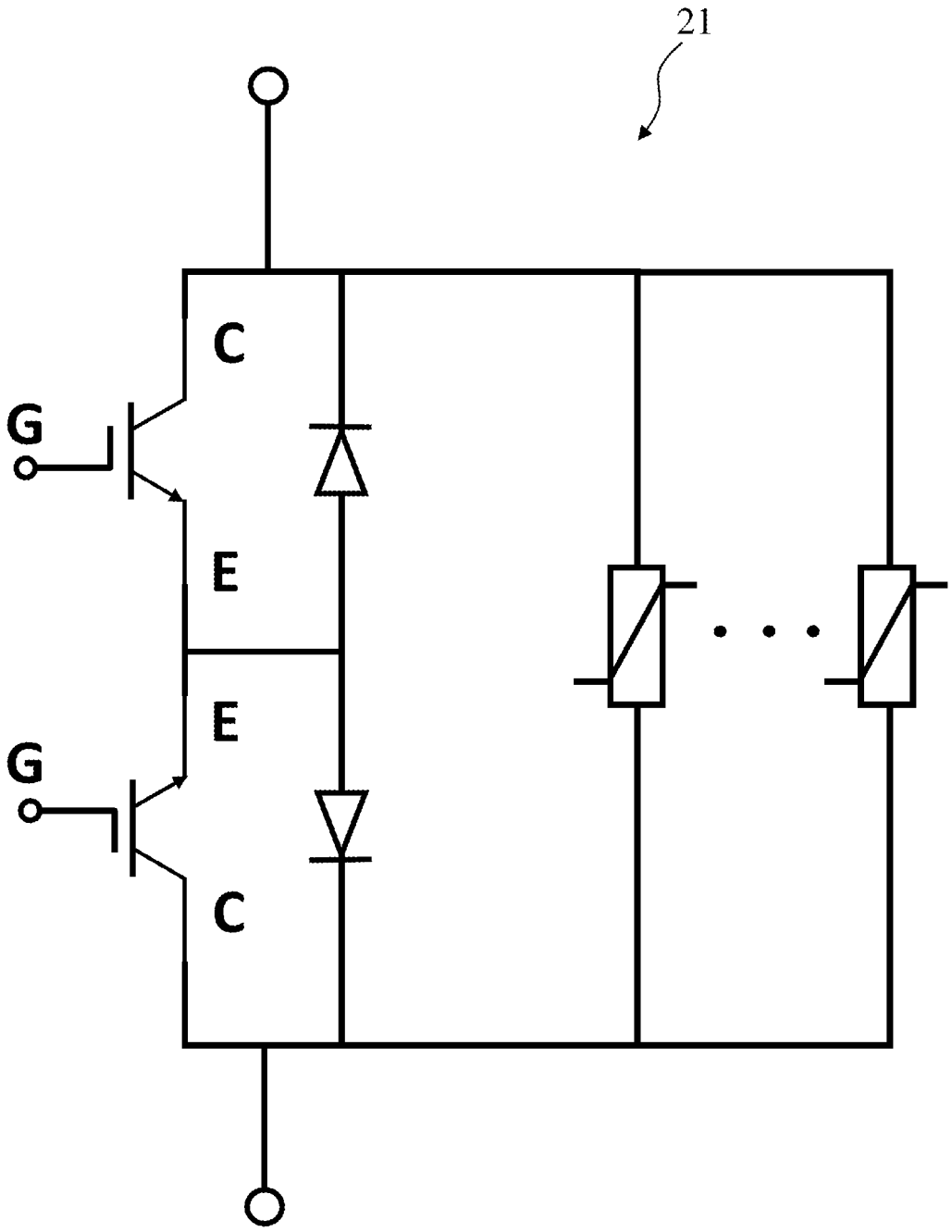
FIG. 4 is a block diagram schematically illustrating second electronic means used in a DC switching apparatus according to an exemplary embodiment of the present disclosure.

For example, FIG. 4 schematically shows an exemplary embodiment of a semiconductor device 21 where two IGBTs can be used in order to take into account a possible different polarity of the current once a circuit breaker 100 like the one of FIG. 9 is installed in operations.

FIG. 5 schematically represents a bipolar DC circuit breaker where a second mechanical switching device 10A, for example, a second pole of the DC circuit breaker, is connected in parallel with a semiconductor device 21A mirrored with respect to the semiconductor device 21, to ensure the system bipolarity in case of a semiconductor able to switch only one current polarity. In this example, also a diode 26A is mirrored with respect to the diode 26.

Exemplary embodiments of the present disclosure, avoid the use of permanent magnets in dealing with low currents.

In addition, and as already discussed, the electronic means 20 with the associated semiconductor device 21 can be realized as a stand-alone component, for example, they constitute or can be part of an electronic relay, or they can be a separate electronic device indicated in FIGS. 12 and 10 by the reference number 400. Hence, the present disclosure encompasses also an electronic device, wherein it includes electronic means 20 including at least one semiconductor device 21 which is suitable to be positioned along a secondary path 201 of an associated DC circuit and connected in parallel with a mechanical switching device 10 which is suitable to be positioned along an operating path 200 of the DC circuit, the mechanical switching device 10 including a fixed contact 11 and a corresponding movable contact 12 which can be actuated between a closed position where the contacts 11, 12 can be coupled to each other and current flows along the operating path 200, to an open position where the contacts 11, 12 can be separated from each other to interrupt the flow of current along the operating path, wherein an electric arc can ignite between the contacts 11, 12 when the movable contact 12 starts separating from the fixed contact 11. The electronic means 20 can be configured to allow commuting (up to) the full flow of current from the operating path to the secondary path and cause the semiconductor device 21 extinguishing an electric arc ignited when the movable contact 12 separates from the fixed contact (only) when the first mechanical switching device fails to extinguish it by itself.

The apparatus 100 and method thus conceived can be susceptible of modifications and variations, all of which can be within the scope of the exemplary concept as defined in the appended claims and previously described, including any partial or total combinations of the above described embodiments, which have to be considered included in the present disclosure even though not explicitly described; all details can further be replaced with other technically equivalent elements. For example, the apparatus 100 has been described by making reference to a molded case circuit breaker but it can be any type of similar current protection devices, for example, a miniature circuit breaker (MCB), a disconnector, or other protection device or types of components as desired. Under normal operating conditions, the semiconductor device could be kept initially also in on-state for example, according to the embodiment of FIG. 5.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A direct current switching apparatus comprising:

at least a first mechanical switching device to be positioned along an operating path of an associated DC circuit, said mechanical switching device including a fixed contact and a corresponding movable contact, wherein an electric arc is ignited between said contacts when said movable contact starts separating from said fixed contact; and electronic means for switching at least one semiconductor device to a current conductive state to commute the flow of current from said operating path to a secondary path and extinguish the electric arc through said semiconductor device when said first mechanical switching device fails to extinguish the electric arc, wherein said electronic means includes the at least one semiconductor device, a resistor and an inductor connected in series along the secondary path, wherein the at least one semiconductor device is positioned along said secondary path and is connected in parallel with said first mechanical switching device, and wherein commutation is driven by a voltage difference between an arc voltage and a voltage over the resistor and the inductor limits a current commutation rate to the secondary path.

2. The switching apparatus according to claim 1, wherein said electronic means are configured to allow commuting the flow of current from said operating path to said secondary path when a level of flowing current is below a predefined threshold.

3. The switching apparatus according to claim 1, wherein said at least one semiconductor device is in a non-conductive state when said fixed and movable contacts are in said closed position, and wherein said electronic means are configured for switching said at least one semiconductor device in the current conductive state after a first predetermined interval of time has elapsed from an instant said movable contact starts separating from the corresponding fixed contact.

4. The switching apparatus according to claim 3, wherein said electronic means are configured for subsequently switching said at least one semiconductor device to the non-conductive state either after a second predetermined interval of time has elapsed with another semiconductor device in the conductive state or when the level of current flowing through said secondary path exceeds said predetermined threshold before said second predetermined interval of time has elapsed.

5. The switching apparatus according to claim 4, wherein said electronic means includes voltage monitoring means for monitoring the voltage across said at least one semiconductor device and comparing the monitored voltage with a predetermined threshold.

6. The switching apparatus according to claim 1, wherein said resistor is configured to prevent a commutation of additional current from the operating path to the secondary path when the current flowing along the secondary path exceeds a predetermined threshold.

7. The switching apparatus according to claim 6, wherein said electronic means includes voltage monitoring means for monitoring the voltage over said resistor.

8. The switching apparatus according to claim 1, wherein said electronic means are configured to be powered by the voltage generated by the electric arc ignited between said fixed and movable contacts when said movable contact separates from said fixed contact.

9. The switching apparatus according to claim 8, comprising:

a plurality of first mechanical switching devices housed inside said casing, each current switching device having at least a respective fixed contact and a corresponding moving contact which can be actuated to move from an initial closed position in which the moving contact is coupled with an associated fixed contact to an open position where the moving contact separates from the associated fixed contact, wherein said plurality of first mechanical switching devices are connected in series to each other, with another semiconductor device connected in parallel to one of said plurality of first mechanical switching devices.

10. The switching apparatus according to claim 1, comprising:

at least a first terminal and a second terminal suitable for input and output electrical connection with said associated DC circuit protruding externally from a casing, respectively, wherein said first mechanical switching device is positioned inside said casing, and wherein said electronic means including said at least one semiconductor device are positioned inside or outside said casing.

11. A method for switching a direct current circulating along an associated DC circuit, the DC circuit including, along an operating path, at least a first mechanical switching device having a fixed contact and a corresponding movable contact, wherein an electric arc can ignite between said contacts when said movable contact starts separating from said fixed contact, and electronic means having at least one semiconductor device, a resistor, and an inductor, said at least one semiconductor device being positioned along a secondary path of said DC circuit and connected in parallel with said first mechanical switching device, and a resistor and an inductor connected in series with the at least one semiconductor device along the secondary path, the method comprising:

switching the at least one semiconductor device to a current conductive state when current in the operating path is below a predetermined threshold to commute the flow of current from said operating path to said secondary path;

extinguishing the electric arc, through said at least one semiconductor device, when said first mechanical switching device fails to extinguish the electric arc;

driving commutation of the current flow through a voltage difference between a voltage of the electric arc and a voltage over the resistor; and limiting a current commutation rate to the secondary path through the inductor.

12. The method according to claim 11, wherein said step of commuting includes commuting the flow of current from said operating path to said secondary path when a level of flowing current is above zero and below the predetermined threshold.

13. The method according to claim 11, wherein said step of commuting includes switching said at least one semiconductor device in a current conductive state after a first predetermined interval of time has elapsed from the instant said movable contact starts separating from the corresponding fixed contact.

14. The method according to claim 13, comprising:

subsequently switching said at least one semiconductor device to a non-conductive state after a second predetermined interval of time has elapsed with another semiconductor device in a conductive state or when a level of current flowing through said secondary path exceeds a predetermined threshold before said second predetermined interval of time has elapsed.

15. The method according to claim 11, wherein said step of commuting includes blocking commutation of current from the operating path to the secondary path when the current flowing along the secondary path exceeds the predetermined threshold.

16. An electronic device, comprising:

electronic means having at least one semiconductor device, a resistor, and an inductor, wherein the at least one semiconductor device is, positioned along a secondary path of an associated DC circuit and connected in parallel with a mechanical switching device which is suitable to be positioned along an operating path of said DC circuit, and the resistor and the inductor are connected in series with the at least one semiconductor device along the secondary path, said mechanical switching device including a fixed contact and a corresponding movable contact which can be actuated between a closed position where said contacts are coupled to each other and current flows along said operating path, to an open position where said contacts are separated from each other to interrupt the flow of current along said operating path, said electronic means are configured for switching the at least one semiconductor device to a current conductive state to commute the flow of current from said operating path to said secondary path and extinguishing through said at least one semiconductor device an electric arc ignited when said movable contact separates from said fixed contact and current in the operating path is below a predetermined voltage threshold such that said first mechanical switching device fails to extinguish the electric arc, wherein commutation is driven by a voltage difference between an arc voltage and a voltage over the resistor and the inductor limits a current commutation rate to the secondary path.

* * * * *